US005605394A

United States Patent [19]

Chen

[11] Patent Number: 5,605,394

[45] Date of Patent: Feb. 25, 1997

[54] FLASHLIGHT

[75] Inventor: Meng J. Chen, Taichung Hsien, Taiwan

[73] Assignee: Regitar Power Co., Ltd., Taichung Hsien, Taiwan

[21] Appl. No.: 665,847

[22] Filed: Jun. 19, 1996

[51] Int. Cl.[6] ..... F21L 7/00

[52] U.S. Cl. ..... 362/197; 362/287; 362/427

[58] Field of Search ..... 362/197, 199, 362/287, 427, 205

[56] References Cited

U.S. PATENT DOCUMENTS 2,264,284 12/1941 Bassett ..... 362/197 X 2,349,453 5/1944 Noel ..... 362/197

5,161,095 11/1992 Gammache ..... 362/199 X

*Primary Examiner*—Stephen F. Husar

*Attorney, Agent, or Firm*—Morton J. Rosenberg; David I. Klein

[57] ABSTRACT

A flashlight including an elongated housing having a spherical seat at an upper end thereof and containing a battery, the spherical seat being formed with a plurality of grooves on an inner side thereof, a head assembly pivotally mounted in the spherical seat and including a rotatable head carrying a light bulb, the head being provided with a resilient member at a bottom thereof adapted to engage with the grooves, and means for switching the flashlight on and off, whereby the flashlight can be set to keep illuminating a particular place as desired.

4 Claims, 5 Drawing Sheets

FLASHLIGHT

BACKGROUND OF THE INVENTION

1. Field of the Invention

This invention relates to a flashlight and in particular to one having a rotatable head which can be kept at a desired orientation.

2. Description of the Prior Art

It has been found that the conventional flashlight includes a casing containing a battery, a head assembly mounted on an upper end of the casing and including a head carrying bulb, and a tail assembly mounted on a lower end of the casing. However, the head of such a flashlight is fixed with respect to the casing thereby making it very inconvenient in use especially in the case of maintaining a motorcycle or a car.

Therefore, it is an object of the present invention to provide an improved flashlight which can obviate and mitigate the above-mentioned drawbacks.

SUMMARY OF THE INVENTION

This invention relates to an improved flashlight.

It is the primary object of the present invention to provide a flashlight which has a rotatable head.

It is another object of the present invention to provide a flashlight which is convenient to use.

It is still another object of the present invention to provide a flashlight which can be kept at a desired orientation.

It is still another object of the present invention to provide a flashlight which is simple and sturdy in construction.

It is a further object of the present invention to provide a flashlight which is easy and cheap to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
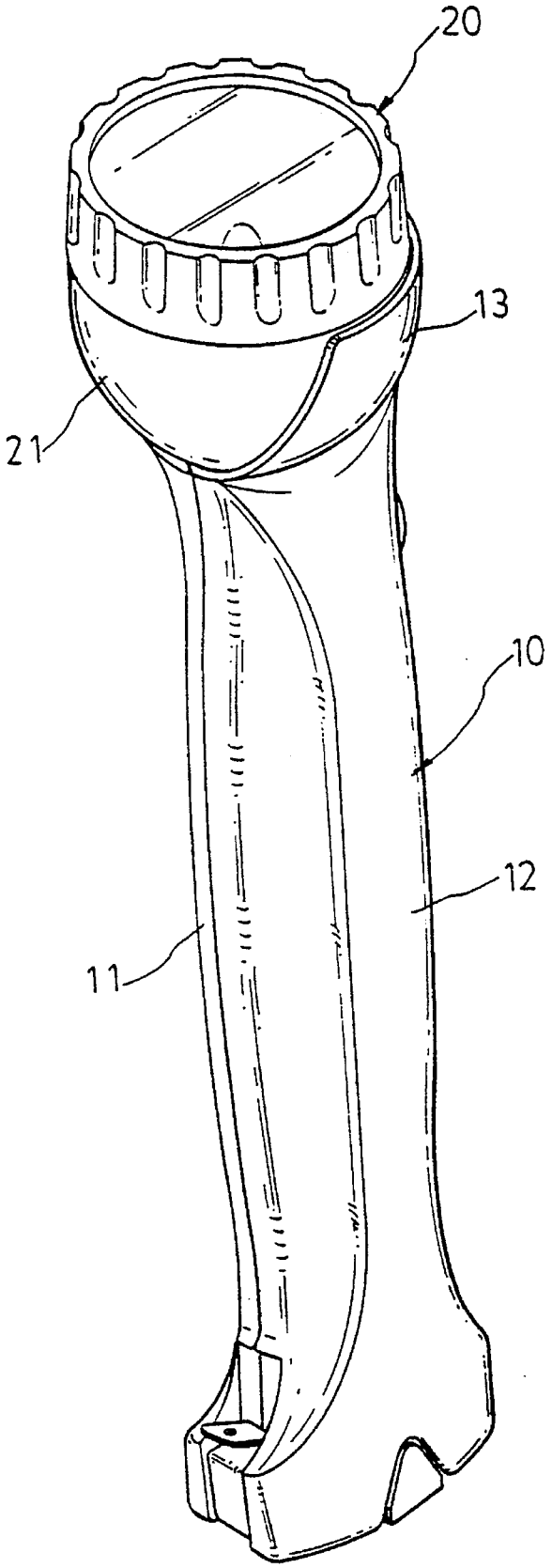
FIG. 1 is a perspective view of a flashlight according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
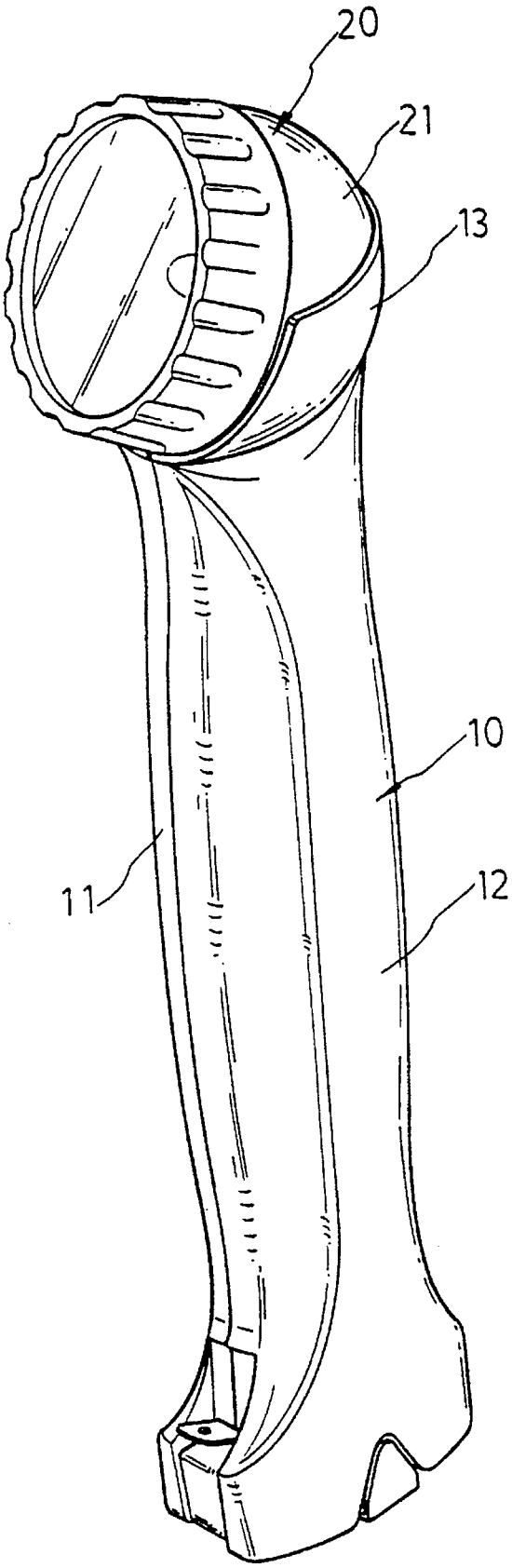
FIG. 2 is a perspective view of the flashlight with the head arranged at an angular position.
Figure 3:
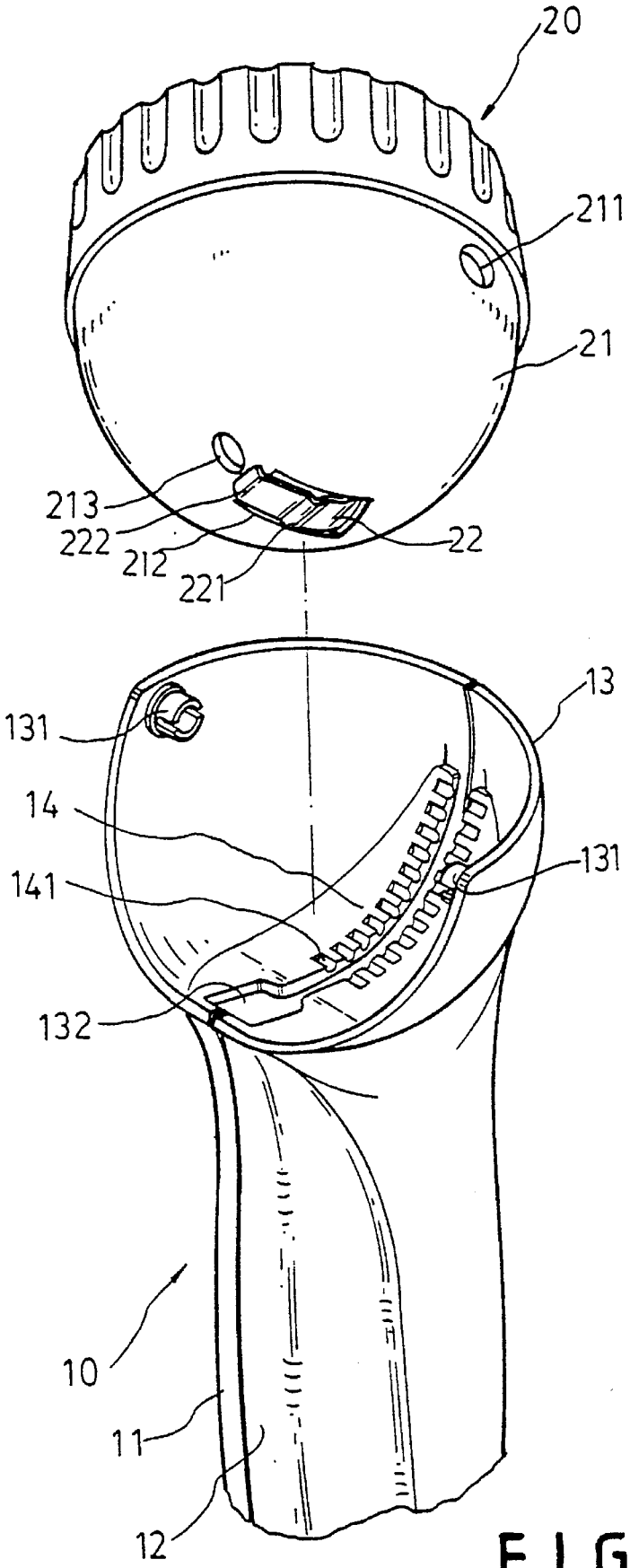
FIG. 3 is an exploded view of the flashlight.

With reference to the drawings and in particular to FIGS. 1, 2 and 3 thereof, the flashlight according to the present invention mainly comprises an elongated housing 10 and a head assembly 20. The means for switching the flashlight and the socket member mounted in the head assembly 20 for receiving a light bulb may be of any structure well known to those skilled in the art and are not considered a part of the invention. The housing 10 includes a left half 11 and a right half 12 which form a spherical recess 13 at the upper end when joined together. The inner side of the spherical recess 13 is formed with two tubular members 131 at two opposite positions aligned with a diameter of the spherical recess 13. The two tubular members 131 are of different diameters. The spherical recess 13 has an engaging rack 14 along its central portion. The engaging rack 14 includes two columns of grooves 141 and an opening 132 at the lower end of the engaging rack 14.

The head assembly 20 includes a hemispherical member 21, a lens cap (shown but not numbered) threadedly engaged into the hemispherical member 21, an electrical socket (not shown) mounted within the hemispherical member 21, a light bulb (not shown) received in the electrical socket. The hemispherical member 21 is provided with a resilient member 22 at the bottom which tends to engage with the grooves 141 of the housing 10. The resilient member 22 is provided with a protuberance 221 at the central portion thereof and an angular edge 222 at an end thereof. The hemispherical member 21 has a hole 213 at the bottom for the passage of electrical wires (not shown) and the spherical recess 13 has an opening 132 aligned with the hole 213. The hemispherical member 21 is formed with two opposite openings 211 of different diameters which are adapted to receive respective tubular members 131 of the housing 10 so as to prevent the head assembly 20 from wrongly engaging with the housing 10.

Figure 4:
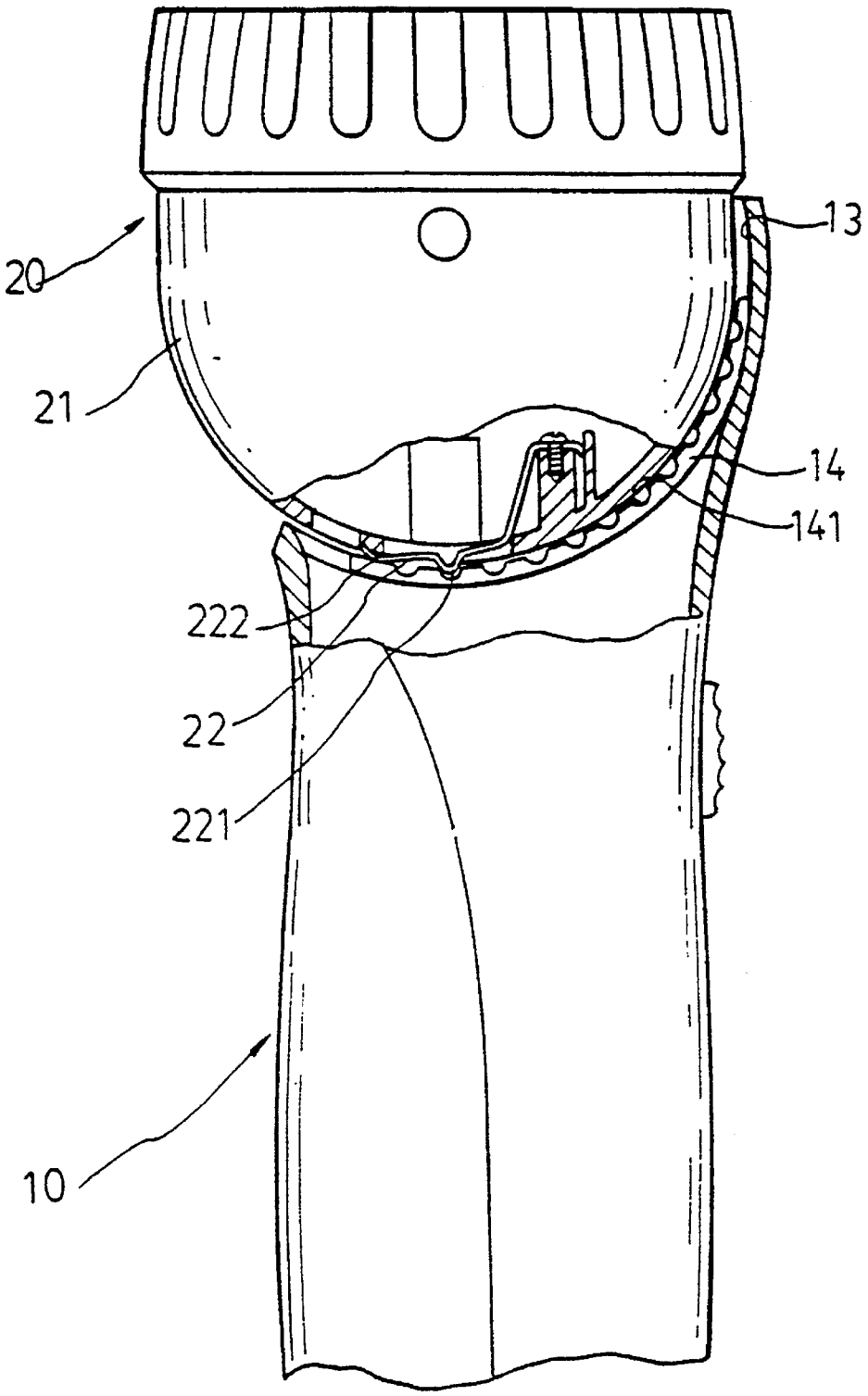
FIG. 4 is a sectional view of the flashlight.
Figure 5:
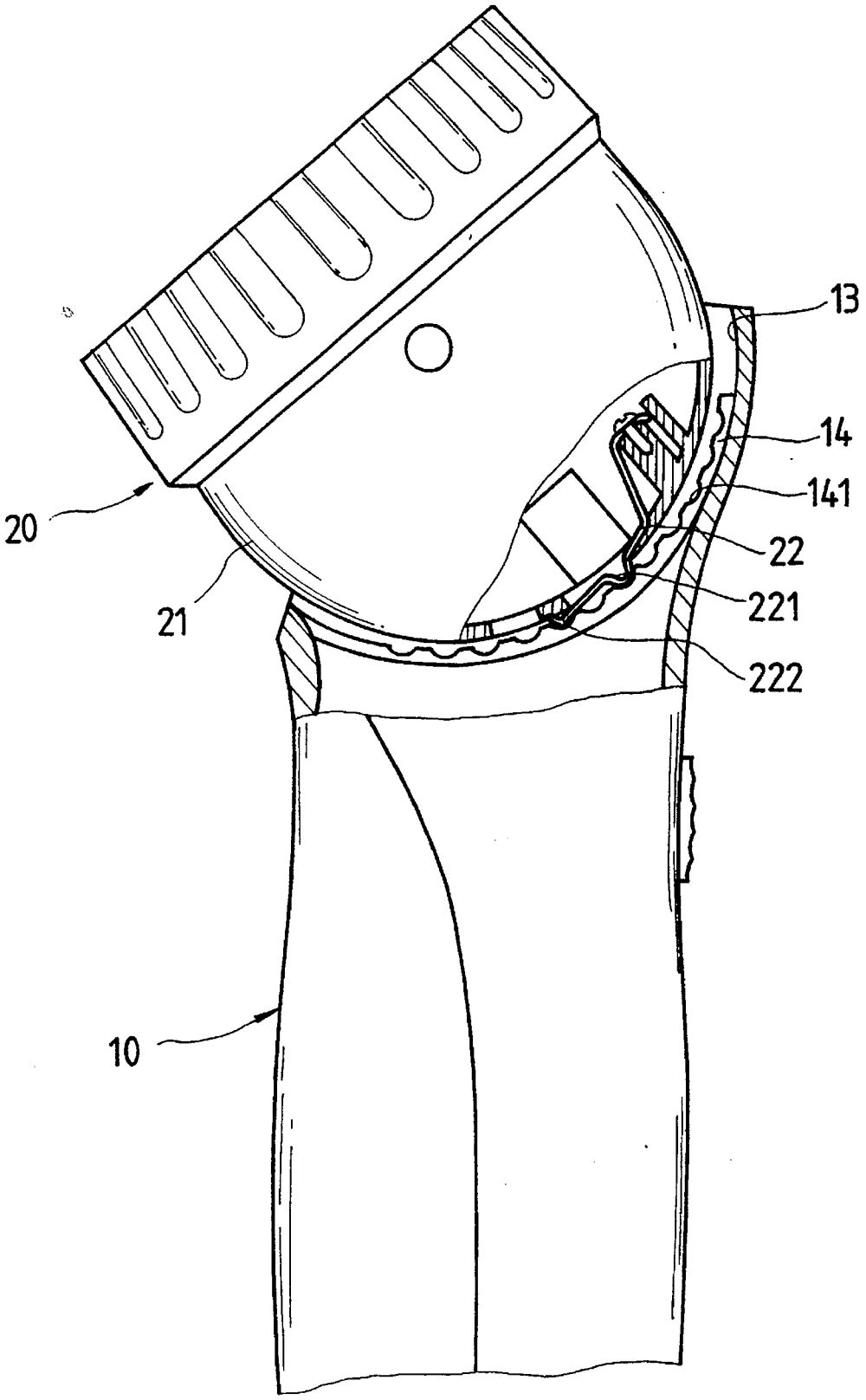
FIG. 5 illustrates the working principle of the present invention.

When the head assembly 20 is rotated to a certain angular position, the protuberance 221 and the angular edge 222 of the resilient member 22 will engage with respective grooves 141 of the housing 10 thereby fixing the head assembly 20 at a desired orientation and therefore enabling the flashlight to keep illustrating a particular place as desired (see FIGS. 4 and 5).

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A flashlight comprising:

an elongated housing having a spherical seat at an upper end thereof and containing a battery, said spherical seat being formed with a plurality of grooves on an inner side thereof;

a head assembly pivotally mounted in said spherical seat and including a rotatable head carrying a light bulb, said head being provided with a resilient member at a bottom thereof tending to engage with said grooves; and means for switching said flashlight on and off.

2. The flashlight as claimed in claim 1, wherein said resilient member is provided with a protuberance at a central portion thereof and an angular edge at an end thereof.

3. The flashlight as claimed in claim 1, wherein said spherical recess of said housing is provided with two opposite tubular members of different diameters and said head has two opposite openings of different diameters adapted to receive said tubular members.

4. The flashlight as claimed in claim 1, wherein said head has a hole at a bottom for passage of electrical wires and said spherical recess has an opening aligned with said hole.

* * * * *